US005337990A

United States Patent [19]

Brown

[11] Patent Number: 5,337,990

[45] Date of Patent: Aug. 16, 1994

[54] DUAL PURPOSE ADJUSTABLE TREE STAND UNIT

[76] Inventor: Curtis W. Brown, 2600 Gracy Farms, Austin, Tex. 76787

[21] Appl. No.: 926,274

[22] Filed: Aug. 10, 1992

[51] Int. Cl.[5] ..... F16M 13/00

[52] U.S. Cl. ..... 248/526; 248/528

[58] Field of Search ..... 248/528, 523, 524, 525, 248/526, 527, 538, 539, 351, 188.6, 188.7, 188.8, 188.91; 47/42, 43

[56] References Cited

U.S. PATENT DOCUMENTS

| | | | |
|---|---|---|---|
| 694,867 | 3/1902 | Krick | 248/524 |
| 2,327,403 | 8/1943 | Coupanger . | |
| 2,341,542 | 2/1944 | Grime | 248/188.6 |
| 2,938,304 | 5/1960 | Thomas et al. . | |
| 3,028,132 | 4/1962 | Austenson . | |
| 3,058,707 | 10/1962 | Lego | 248/52 X |
| 3,295,802 | 1/1967 | Leatherman | 248/523 |
| 3,301,512 | 1/1967 | Nyberg | 248/524 |
| 3,469,342 | 9/1969 | Morris . | |
| 3,697,026 | 10/1972 | Hambrick . | |
| 4,569,151 | 2/1986 | Hoffbeck . | |
| 4,653,224 | 3/1987 | Weckesserr . | |
| 4,778,140 | 10/1988 | Karlewski | 248/524 |
| 4,825,587 | 5/1989 | Stancil . | |
| 4,930,252 | 6/1990 | Krause et al. . | |
| 5,016,389 | 5/1991 | Odam, Jr. . | |
| 5,114,113 | 5/1992 | Krinner | 248/525 |

FOREIGN PATENT DOCUMENTS

| | | | |
|---|---|---|---|
| 434869 | 2/1948 | Italy | 248/525 |

*Primary Examiner*—David A. Scherbel
*Assistant Examiner*—Korie H. Chan
*Attorney, Agent, or Firm*—Joseph F. Long

[57] ABSTRACT

A rugged adjustable tree stand designed to hold trees of varying sized in an adjustable upright position and to provide water to prevent drying and shedding of needles from the tree is disclosed.

4 Claims, 4 Drawing Sheets

DUAL PURPOSE ADJUSTABLE TREE STAND UNIT

BACKGROUND OF THE INVENTION

For many years Christmas trees of various sizes have been used in American houses. Normally a makeshift wooden foot or a light metal mounting unit is used with varying degrees of success to mount the Christmas tree for use. Various sprays or coatings have been used to coat the needles of the tree to preserve freshness of appearance and to prevent the needles from drying out.

There exists a need for a low cost reusable mounting unit with legs adjustable to hold a tree, that may not be perfectly straight, in a desired position. Further, in many homes wherein the tree is decorated and in use for more than a few days there exists a need to maintain the tree in a fresh condition to reduce the fire hazard of drying or dried needles.

This invention addresses both needs. In a preferred embodiment of the invention, an adjustable metal strap slips through each of three U-shaped mounting pieces or clevis, each of which is pivotally connected near a mid-point with dual metal rods that connect on the other end near a mid-point of legs with a U-shaped cross section. The adjustable metal strap is rigidly attached to the tree base after positioning the mounting pieces approximately 120 degrees apart. Dual coil spring in each of the three mounting pieces interact with the rods pivotally connecting the U-shaped cross section legs and the mounting pieces to push the legs toward the tree when the unit is assembled on a tree.

The lower end of each leg is flattened to form a foot. The rods, which may be approximately ¼" in diameter, are pivotally connected with the mounting pieces and the legs, which may be 15" to 18" long for a normal size tree. Differing sizes of units would be used for very large and very small trees but would be of the same design and operate in the same way. With the unit attached, the tree may be manually tilted and the legs adjusted to hold the tree in a desired upright position. For a tree with a perfect trunk, the tree would be exactly vertically adjusted as viewed from either side.

In the preferred embodiment of the invention, a needle similar to that used to fill a basketball with air may be inserted manually in the tree at an angle to be close to the cambium layer of the tree and water under pressure is fed through the needle. Experiments have indicated that a tree will appear perfectly fresh after two weeks using this method of providing water to the tree.

In another embodiment, the same support system is used and the adjustable strap is adjusted to allow the butt end of the tree to be held in water in a relatively shallow container.

SUMMARY OF THE INVENTION

In a preferred embodiment, an adjustable leg tree stand with means to continuously add water below the cambium layer of the trunk of a tree comprises three sets of rods rotatably connected on one end to mounting pieces slidably attached to an adjustable metal strap that may be rigidly attached to the tree base, and rotatably connected at the other end to the approximate midpoint of a leg with a U shaped cross section, thereby allowing the legs to make a non-slidable contact with the tree and to be adjusted to hold the tree in a desired approximate vertical position. In this embodiment, an expandable flexible bag in cylindrical container is equipped with a filling valve to allow filling the bag with water under the normal tap water pressure. After the bag is filled with water a connection is made to a modified needle approximately ⅛" in diameter and the needle is installed at an angle under the cambium layer of the Christmas tree and water under pressure in the expandable bag is continuously fed into the tree to replace water lost from the needles.

A second embodiment is quite similar to the preferred embodiment, but the adjustable metal strap is mounted on the tree so that a container to hold water may be placed between the support legs of the unit with the base of the tree held in water in the container. Water may be manually added to help prevent drying out of the tree.

A third embodiment is similar to the first preferred embodiment, but no provision is made to add water.

DETAILED DESCRIPTION OF THE UNIT

The invention may best be described from the drawings.

Figure 1:
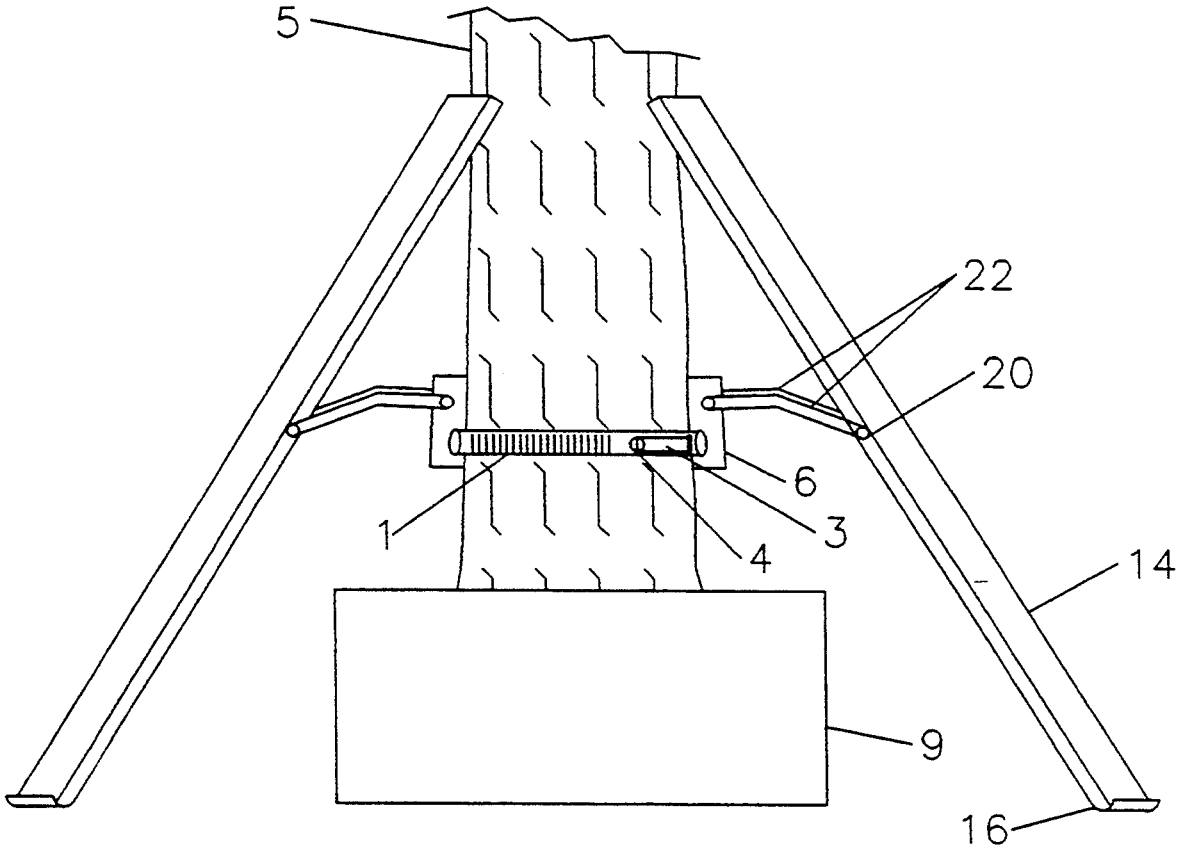
FIG. 1 shows the unit as assembled on a tree base.
Figure 7:
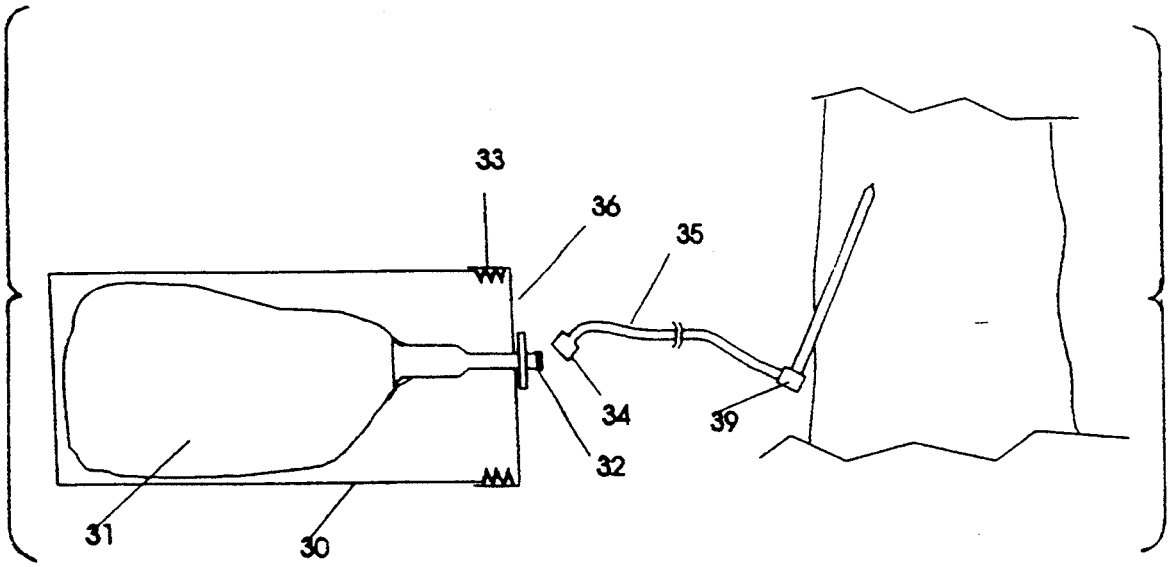
FIG. 7 shows cut-away view of inflatable water bag in restrictive container.
Figure 8:
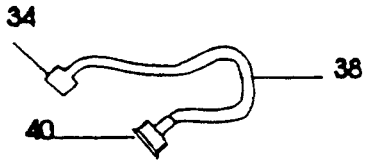
FIG. 8 shows flexible connector for putting water into the tree.

FIG. 1 shows the unit assembled on the base of a tree 5. Each element is described in more detail in FIG. 2 through 8. In FIG. 1 each of three legs 14 are attached through hole 22 to dual leg connector rods 20. The other ends of dual rods 20 are attached by press fitting bent end of the rods into a cylindrical section 21, FIG. 4, held in a U shaped mounting piece or clevis 6, see FIG. 3. The three U shaped mounting pieces 6 are slidably fastened to mounting strap 1, and positioned approximately 120° apart and the strap 1 is then tightened around the tree base 5 using adjustable clamp 3 and adjustment screw 4. In this embodiment, the base of tree 5 is shown setting in a low flat water container 9. In a preferred embodiment, water would be added as indicated in FIGS. 7 and 8.

Figure 5:
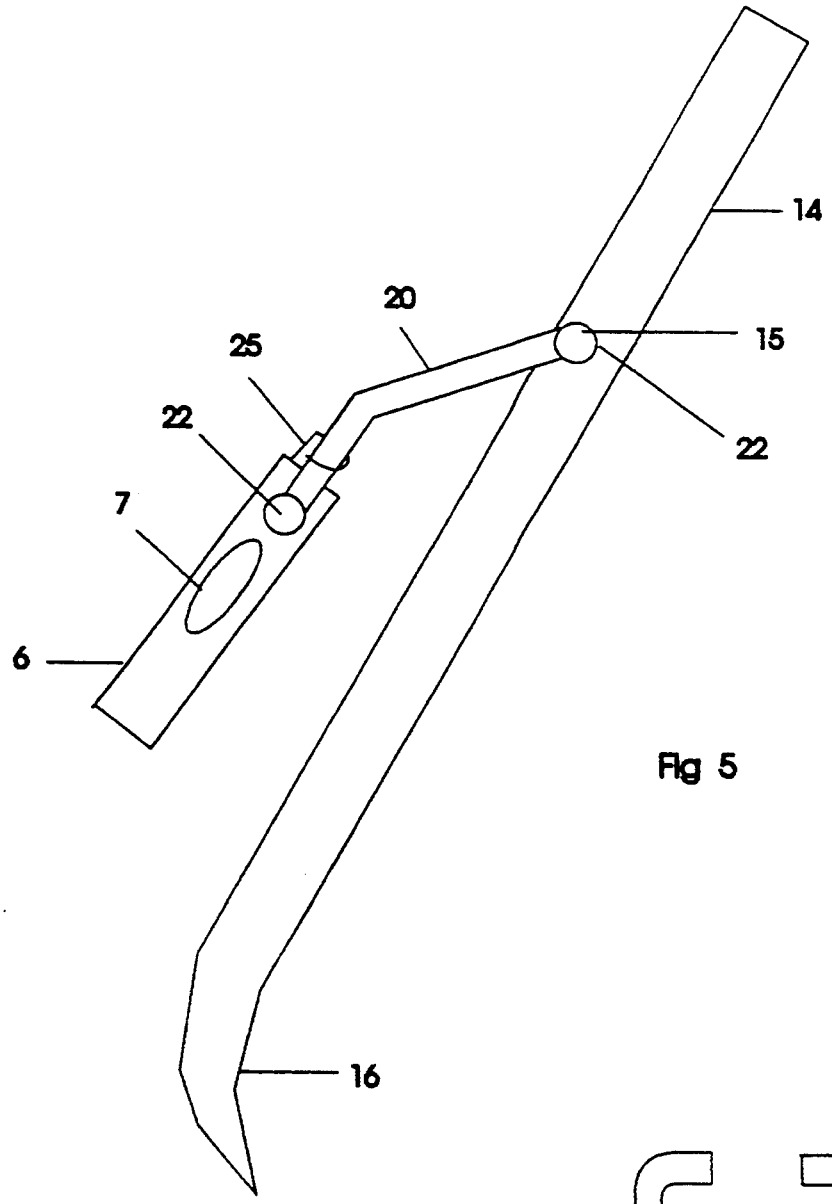
FIG. 5 shows one of a minimum of three mounting legs connected to U shaped mounting piece.
Figure 6:
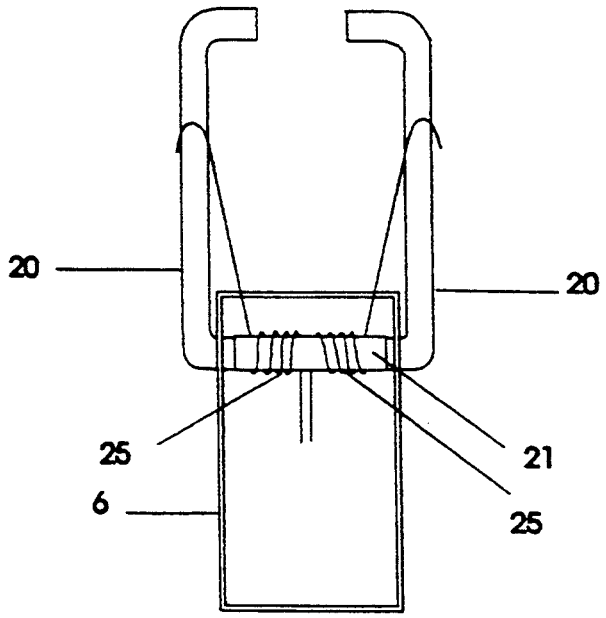
FIG. 6 shows coil springs in mounting piece interacting with mounting rods.

Not shown in FIG. 1 but shown in FIG. 6 are dual springs installed over section 21 in the mounting clevis 6 tending to align connector rods 20 with legs 14 and mounting clevis 6 as indicated in FIG. 5 before assembly, for ease of packaging, ease of assembly and to facilitate leg adjustment.

With the unit assembled and mounting strap 1 tightly affixed to the tree trunk, the weight of the tree is supported by the three legs 14 connected by the three pairs of connector rods 20, each pair of which is connected near a midpoint of a leg 14 on one end and on the other end to clevis 6 which is held tightly against the tree 5 by mounting strap 1. In the unit as outlined, a component of force is pushing against the tree at the top end of each leg and a component of force is pushing against the ground. With placement of 120° apart and Vector analysis, we see that the force exerted against the tree by any two adjacent legs equals the force against the opposite leg where the legs are in similar positions. By inspection, we see that by moving the foot 16 of one leg 14 closer to the trunk 5 that the tree 5 will be held in a position tilted toward the foot 16 that is closest to the tree. Thus, the unit as described will hold the tree 5 in either a vertical or off vertical position by adjusting the distance between the foot 16 of the leg 14 and the base of the tree.

Figure 2:
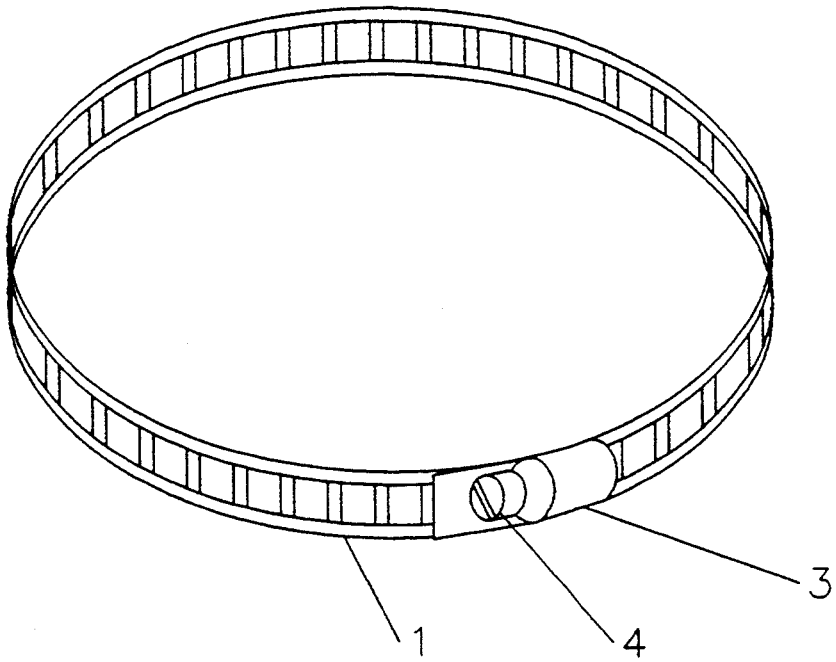
FIG. 2 shows mounting strap.

In FIG. 2 we show mounting strap 1 which is quite similar to a metal hose clamp. This may be a metal strap approximately ½" wide with slotted openings with one end of the strap attached to an adjustable clamp 3 and with the other end of strap 1 sliding into clamp 3 and moved through clamp by turning adjustment screw 4.

Figure 3:
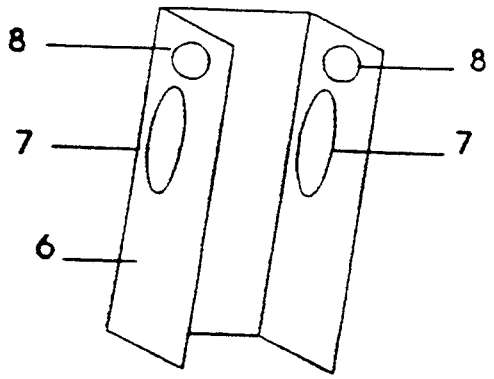
FIG. 3 shows U shaped slidable mounting piece or clevis.

In FIG. 3 we show the U shaped mounting piece or clevis 6 with slots 7 sized to slide easily over strap 1, FIG. 1, and with holes 8 which may be approximately ¼" in diameter to contain ends of connector rods 22, FIG. 1.

Figure 4:
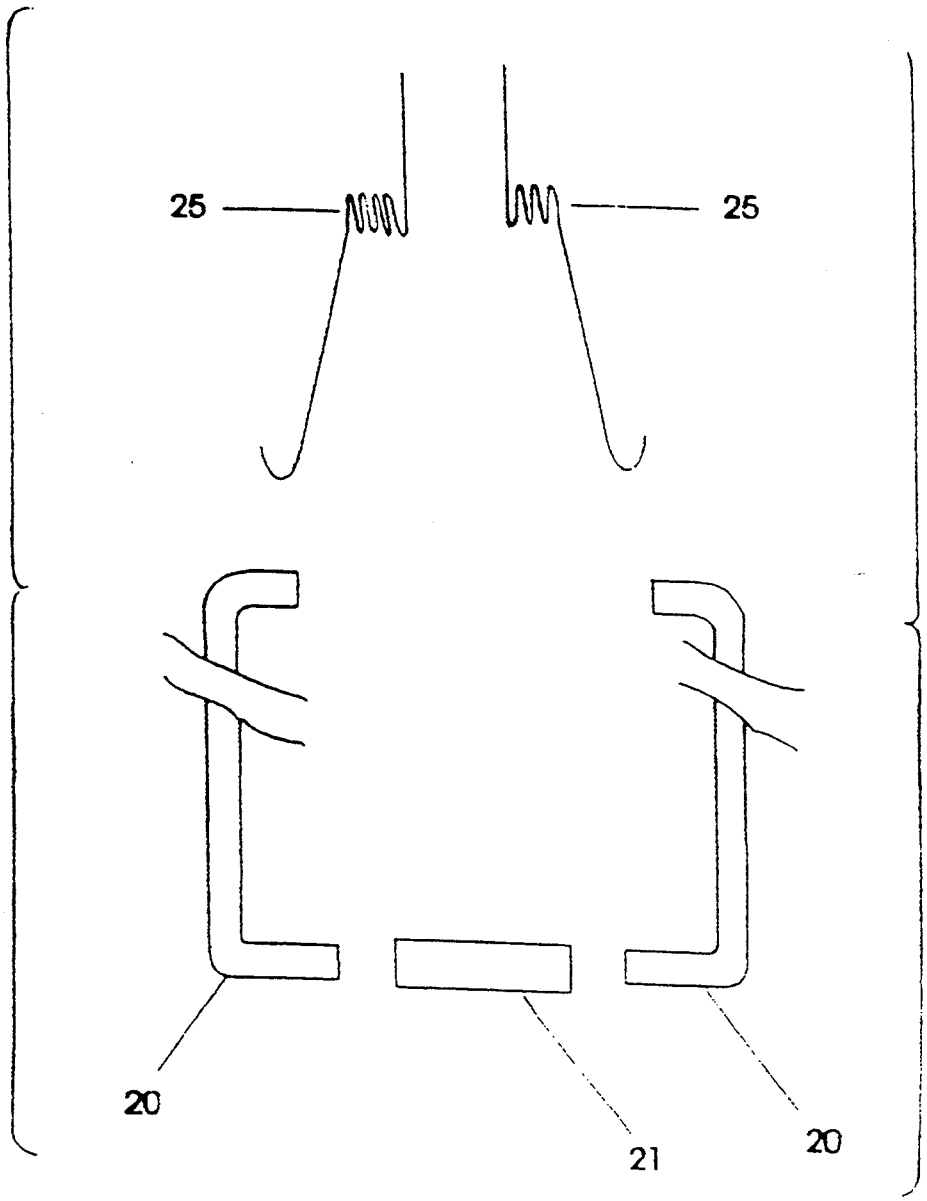
FIG. 4 shows dual mounting rods for each leg.

In FIG. 4 we show one pair of the minimum of three pairs of leg connector rods 20. These rods 20 may be approximately ¼"×5" with each rod having right angle bends at each end. One end of rods 20 are connected to clevis 6 through holes 8, FIG. 3, by press fitting into section 21 that is held between holes 8 in clevis 6. The other ends snap into holes 15 in legs 14. Springs 25 are held as shown in FIG. 6.

In FIG. 5 we show a leg 14 with a U shaped cross section and a flattened end to form foot 16. This leg is formed from a metal channel approximately 1¼" wide with approximately ½" arms and would normally be 12" to 18" long. A ¼" hole 15 through the leg 14 allows connecting the pair of rods 20, FIG. 4, with the right angled ends of rods 20 snapping into hole 15.

In FIG. 6 we show a cutaway detail indicating interconnection of dual coil springs 25 installed around section 21, with section 21 holding right angled ends of leg connector 20 by being press fit therein after going through each side of clevis 6 with a beginning end of each coil spring being held against the base of clevis 6 and a terminal end of coil spring 25 being bent to tend to move connector leg rod to be parallel to clevis 6.

In FIG. 7 we show an elastic inflatable rubber bag 31 similar to one used inside a football inside restrictive container 30. Screw cap 33 has an air vent opening 36 and an opening to admit filling valve 32. Valve 32 is similar to a valve stem on a tire and is opened by depressing a spring loaded to close internal valve core. Female fitting 34 is fitted with an internal projection to depress the spring loaded internal valve core to open. With valve 34 open and the elastic inflatable bag 31 essentially filled with water under pressure the bag will exert pressure continuously to force water through hose 35 into needle 39. With needle 39 embedded in the tree trunk, preferably at an angle, water will be absorbed in a layer of wood of the tree and out to the cambium layer and travel through the cambium layer to all parts of the tree including the leaves or needles to keep the tree in a nearly fresh position. Instead of water alone, it is probable that an aqueous sodium borate solution could be used thereby "fireproofing" the tree to some degree.

In FIG. 8 we show a filling hose to fill elastic inflatable bag 31, FIG. 7. With female connector 40 attached to a water faucet and female connector 34 threaded on valve 32, FIG. 7, the water faucet may be opened and water would flow through flexible hose 38, and through valve 32, FIG. 7, to fill bag 31 until pressure in the bag reaches the water faucet pressure which is normally at least 10 psi. Bag 31 and container 30 is preferably of translucent material to allow visual inspection to determine the water level in bag 31.

What is claimed is:

1. An adjustable tree stand unit comprising:

a) a flat strap and a manually adjustable fastening means to form and hold said flat strap in a circular configuration and fasten said flat strap in said circular configuration around a trunk of a tree;

b) a minimum of three pairs of rods, a minimum of three legs, and a minimum of three U shaped mounting means with said U shaped mounting means slidably attached to said flat strap in said circulator configuration and acting to rotatably hold a beginning end of each of said minimum of three pairs of rods, with terminal ends of each of said three pairs of rods rotatably fastened to an approximate midpoint of each of said minimum of three legs.

2. An adjustable tree stand unit as in claim 1 wherein each of said U shaped mounting means to pivotally connect said pairs of rods at said beginning end is a U shaped unit with a slot through both sides of said U shaped unit adjacent to said unit base, said slot being sized to admit said flat strap and each of said sides of said U shaped unit having a hole sized to pivotally connect said beginning end of said pair of rods.

3. An adjustable tree stand unit as in claim 2 wherein dual coil springs fitted over pivotal connections in said U shaped mounting means interacts with said U shaped means and said pairs of rods to push said legs against said tree when said adjustable stand is assembled on said tree.

4. An adjustable tree stand unit as in claim 1 further comprising a container means sized to hold a minimum of one quart of water and with a top opening having a minimum of three inches in diameter.

* * * * *